US005938498A

United States Patent [19]

Glynn

[11] Patent Number: 5,938,498

[45] **Date of Patent: *Aug. 17, 1999**

[54] TOY CONSTRUCTION BLOCK SYSTEM WITH INTERBLOCK CONNECTORS FOR EXTENDED SUPPORT STRUCTURES

[75] Inventor: Kenneth P. Glynn, Raritan Township, Hunterdon County, N.J.

[73] Assignee: Ideal Ideas, Inc., Flemington, N.J.

[ * ] Notice: This patent is subject to a terminal disclaimer.

[21] Appl. No.: 08/936,774

[22] Filed: Sep. 24, 1997

Related U.S. Application Data

[63] Continuation-in-part of application No. 08/210,878, Mar. 18, 1994, Pat. No. 5,683,283.

[51] Int. Cl.[6] ..... A63H 33/08

[52] U.S. Cl. ..... 446/124; 446/128

[58] Field of Search ..... 446/85, 93, 94, 446/95, 96, 97, 98, 100, 101, 102, 111, 113, 120, 122, 124, 125, 128

[56] References Cited

U.S. PATENT DOCUMENTS

| | | | |
|---|---|---|---|
| D. 311,935 | 11/1990 | Andersen . | |
| D. 317,478 | 6/1991 | Larsen et al. . | |
| D. 353,852 | 12/1994 | Glynn . | |
| D. 355,940 | 2/1995 | Glynn . | |
| D. 363,516 | 10/1995 | Mathiesen | D21/108 |
| 3,005,282 | 10/1961 | Christiansen . | |
| 3,224,135 | 12/1965 | Wright et al. | 446/95 |
| 3,242,610 | 3/1966 | Christiansen . | |
| 3,638,352 | 2/1972 | Christiansen | 446/102 |
| 4,375,139 | 3/1983 | Chatani | 446/471 |
| 4,430,826 | 2/1984 | Ryaa | 446/124 |
| 4,690,656 | 9/1987 | Frieman et al. | 446/95 |
| 5,137,486 | 8/1992 | Glickman . | |
| 5,257,803 | 11/1993 | Lyman | 446/103 |
| 5,683,283 | 11/1997 | Glynn | 446/128 |

*Primary Examiner*—Robert A. Hafer
*Assistant Examiner*—Laura Fossum
*Attorney, Agent, or Firm*—Kenneth P. Glynn, Esq.

[57] ABSTRACT

The present invention is a toy construction block system which includes a plurality of toy construction blocks and a plurality of interblock connectors. Said blocks each have a main outer structure having a top, four sidewalls and an open bottom. The top has a plurality of symmetrically arranged elongated projections for interlocking with other, similar blocks and the open bottom has an underside to said top which itself has an elongated friction post extending therefrom. The friction post is hollow and is centrally and symmetrically located on the underside. The critical features are that the top has thereon a top recess in alignment with the friction post, a bottom recess within the friction post of the block, and at least one of the four sidewalls has a side recess therein adapted to receive an interblock connector. In preferred embodiments of said interblock connector, each connector has at least an elongated body and first and second ends. At least one of said first and second ends has means for attachment to at least one of said construction blocks. In other embodiments, one of said first and second ends has means for connecting with another interblock connector to enable the user to further extend the structure as desired.

2 Claims, 18 Drawing Sheets

TOY CONSTRUCTION BLOCK SYSTEM WITH INTERBLOCK CONNECTORS FOR EXTENDED SUPPORT STRUCTURES

REFERENCE TO RELATED APPLICATION

This application is a Continuation-in-Part of U.S. Pat. No. not yet assigned receiving Notice of Allowance dated Jun. 12, 1997 on application Ser. No. 08/210,878 filed Mar. 18, 1994, now U.S. Pat. No. 5,683,283 entitled "Construction Blocks for Extended Support Structures" by the inventor herein and having Attorney Docket No. III-132A.

BACKGROUND OF THE INVENTION

1. Field of the Invention

The present invention involves toy construction blocks which have a main outer structure with a top, an open bottom and four sidewalls, and with projections on the top for interlocking with other, similar blocks. More specifically, the present invention includes toy construction blocks with vertical and horizontal orifices or recesses for inserting ends of various interblock connectors.

2. Information Disclosure Statement

Toy construction blocks have been around for perhaps more than a century. Plastic snap-in blocks have likewise existed for many decades. Lego™ blocks (Trademark of Interlego, A. G., offices in Enfield, Conn.), have been popular for decades.

U.S. Pat. No. 3,005,282 to Christiansen describes interlocking blocks with symmetric protrusions and FIG. 12 shows a cut view of a block with a vertical orifice therethrough. However, there is no teaching or showing of interblock connectors, nor is there any suggestion or teaching for recesses on sidewalls as used in the present invention.

U.S. Pat. No. 3,242,610 to Christiansen shows a flexible connector for toy blocks but does not show a sidewall or top insertion of the flexible extension.

U.S. Pat. No. 5,137,486 to Glickman teaches a multiplanar connector element for a construction toy which utilizes strut elements. Such strut elements each have grooves adjacent their end extremities which define an end flange at each extremity for lateral insertion of the element into a pair of spaced gripping arms of a connector element.

U.S. Design Pat. No. 311,935 to Anderson shows a toy building element that includes a block base and a column, but this is a single unit with no horizontal members.

U.S. Design Pat. No. 317,478 to Larsen et al. shows a toy building element that is an elongated open webbed block which apparently acts to extend the height of toy construction blocks, but, again there is no provision for horizontal extensions or connectors.

U.S. Design Pat. Nos. 353,852 and 355,940, both to Glynn, teach a combined toy tubular beam and block and a combined tubular beam and blocks, respectively. Each of said designs shows the combination of an interblock connector with at least one toy construction block, said combination adaptable for use with other such components or in other toy construction block systems.

Notwithstanding the prior art, the present invention is neither taught nor rendered obvious thereby.

SUMMARY OF THE INVENTION

The present invention is a toy construction block system which includes a plurality of toy construction blocks and a plurality of interblock connectors. Said blocks each have a main outer structure having a top, four sidewalls and an open bottom. The top has a plurality of symmetrically arranged elongated projections for interlocking with other, similar blocks and the open bottom has an underside to said top which itself has an elongated friction post extending therefrom. The friction post is hollow and is centrally and symmetrically located on the underside. The critical features are that the top has thereon a top recess in alignment with the friction post, a bottom recess within the friction post of the block, and at least one of the four sidewalls has a side recess therein adapted to receive an interblock connector. In preferred embodiments, a plurality of the four sidewalls has a side recess therein, and the top recess and bottom recess are formed by a continuous and complete orifice or hole directly through the block vertically.

In preferred embodiments of said interblock connector, each connector has at least an elongated body and first and second ends. At least one of said first and second ends has means for attachment to at least one of said construction blocks. In other embodiments, one of said first and second ends has means for connecting with another interblock connector to enable the user to further extend the structure both vertically and horizontally.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
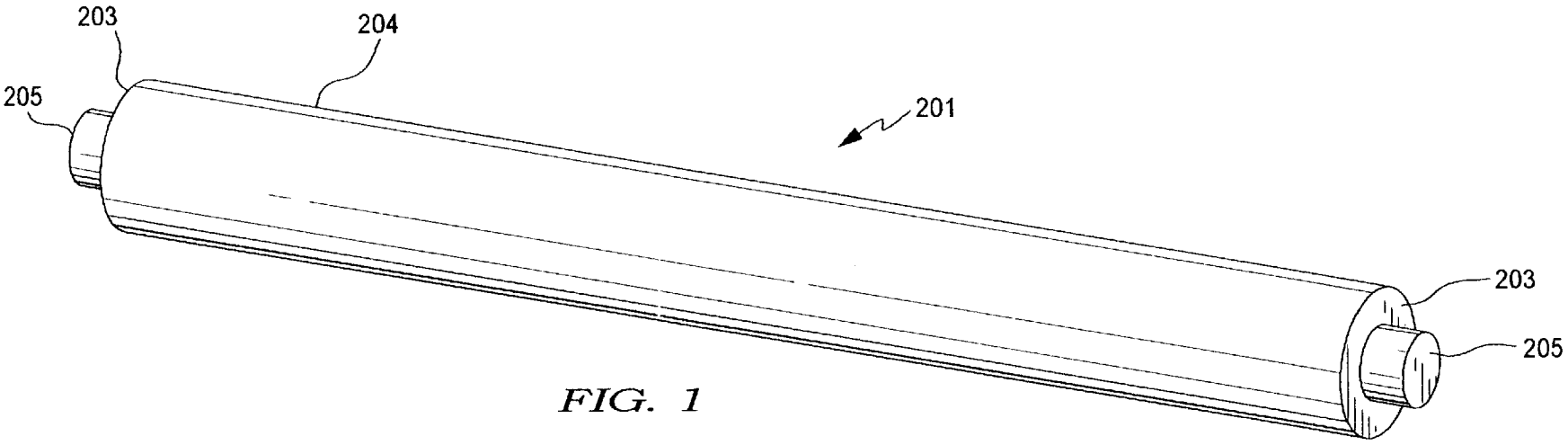
FIG. 1 shows an interblock connector having an elongated circular projection at each of its first and second ends.
Figure 1B:
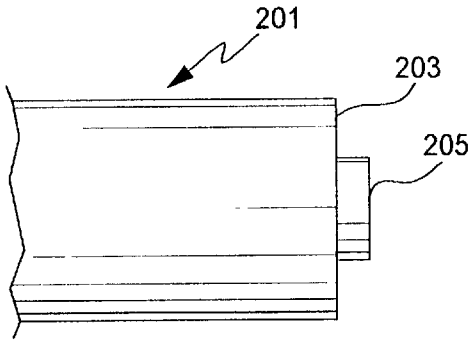
Figure 1A:
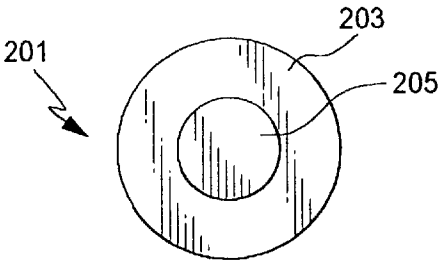
Figure 2:
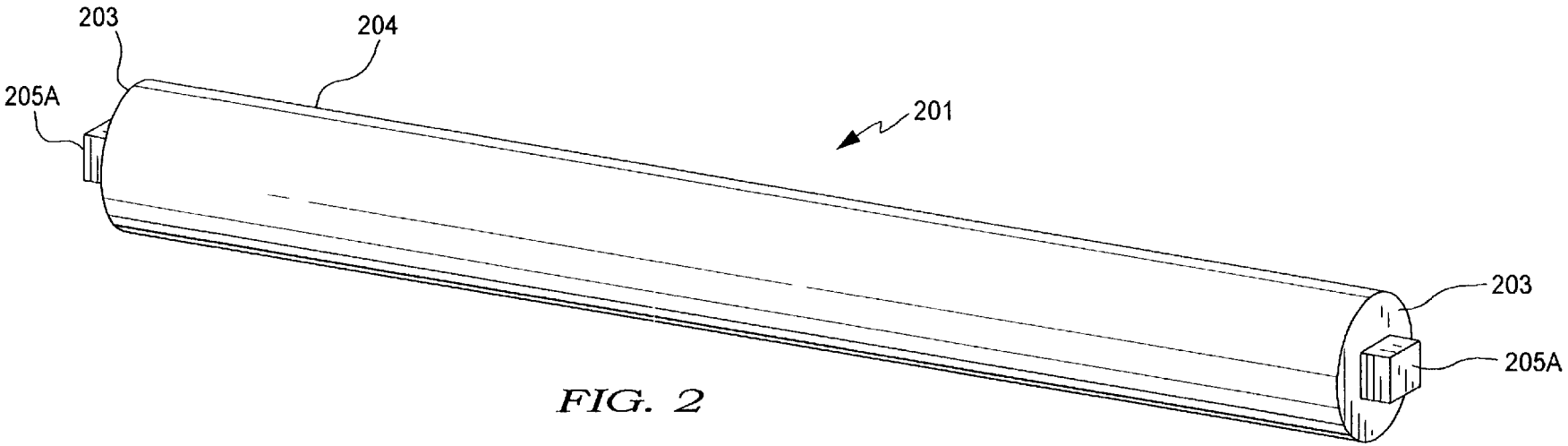
FIG. 2 shows an interblock connector having an elongated square projection at each of its first and second ends.
Figure 2B:
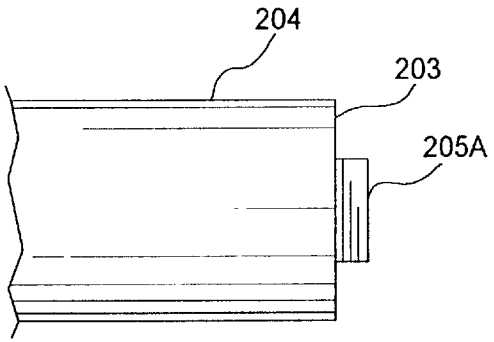
Figure 2A:
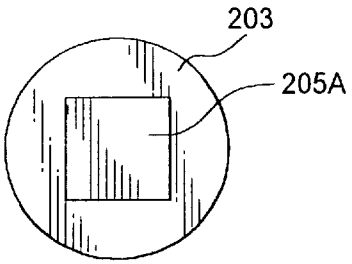
Figure 3:
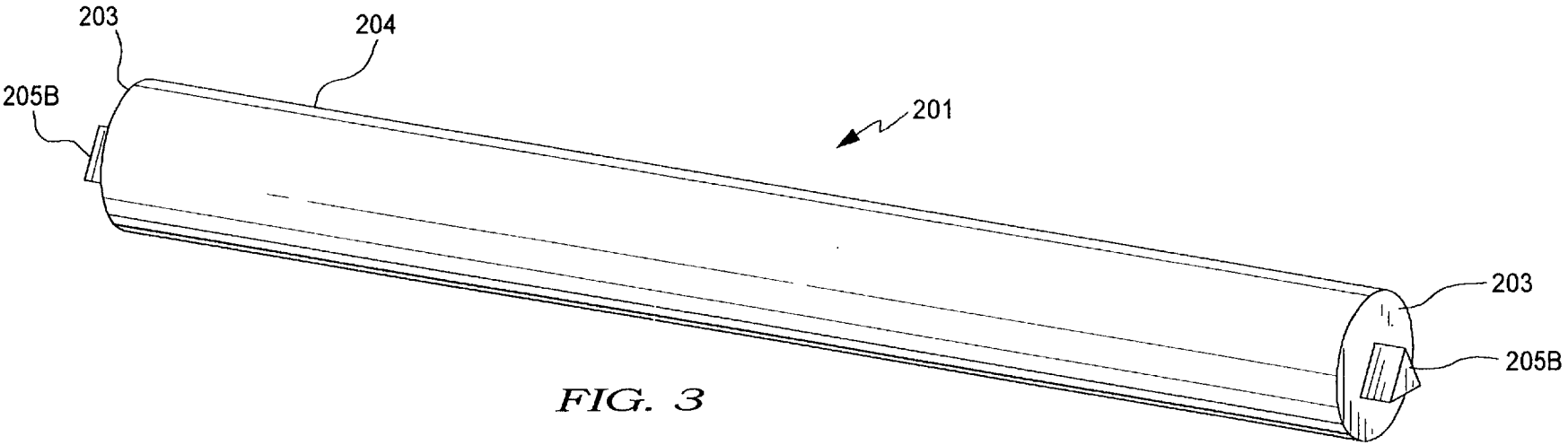
FIG. 3 shows an interblock connector having an elongated triangular projection at each of its first and second ends.
Figure 3B:
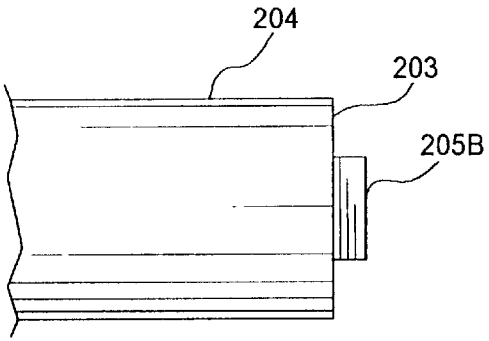
Figure 3A:
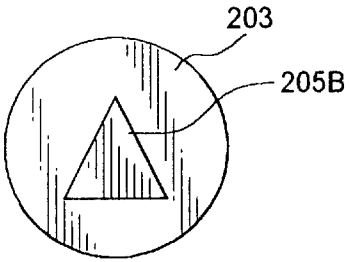
Figure 4:
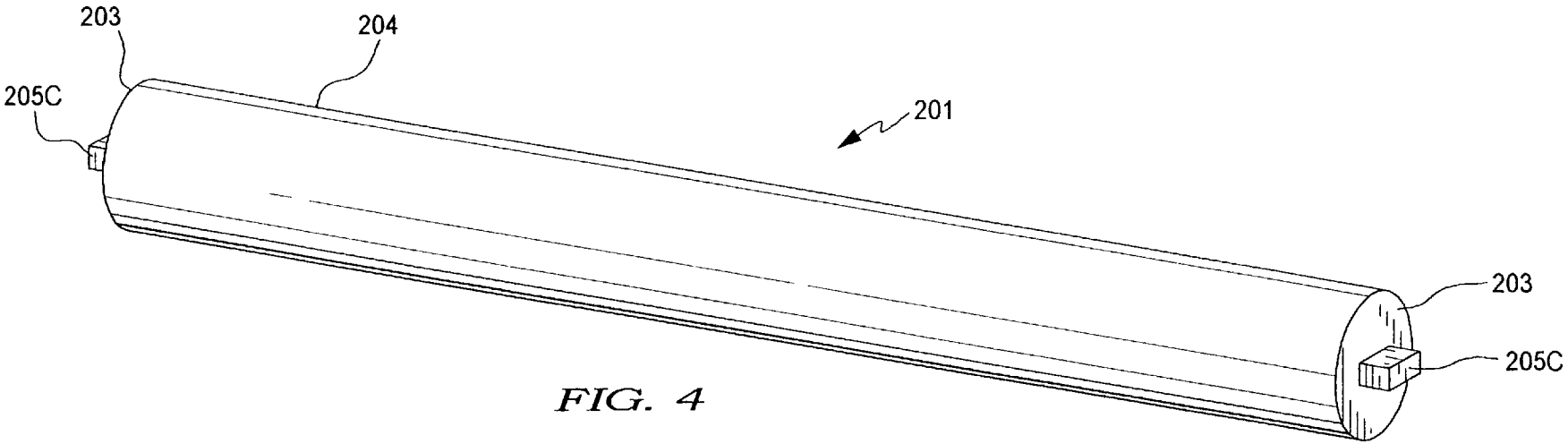
FIG. 4 shows an interblock connector having an elongated rectangular projection at each of its first and second ends.
Figure 4B:
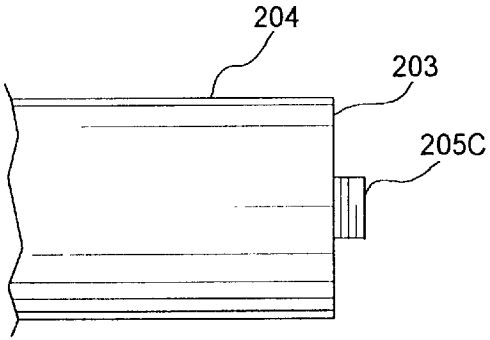
Figure 4A:
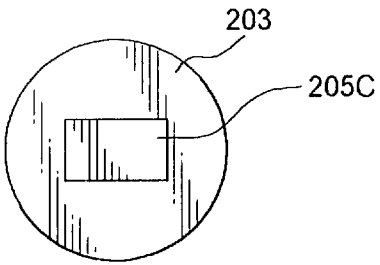
Figure 5:
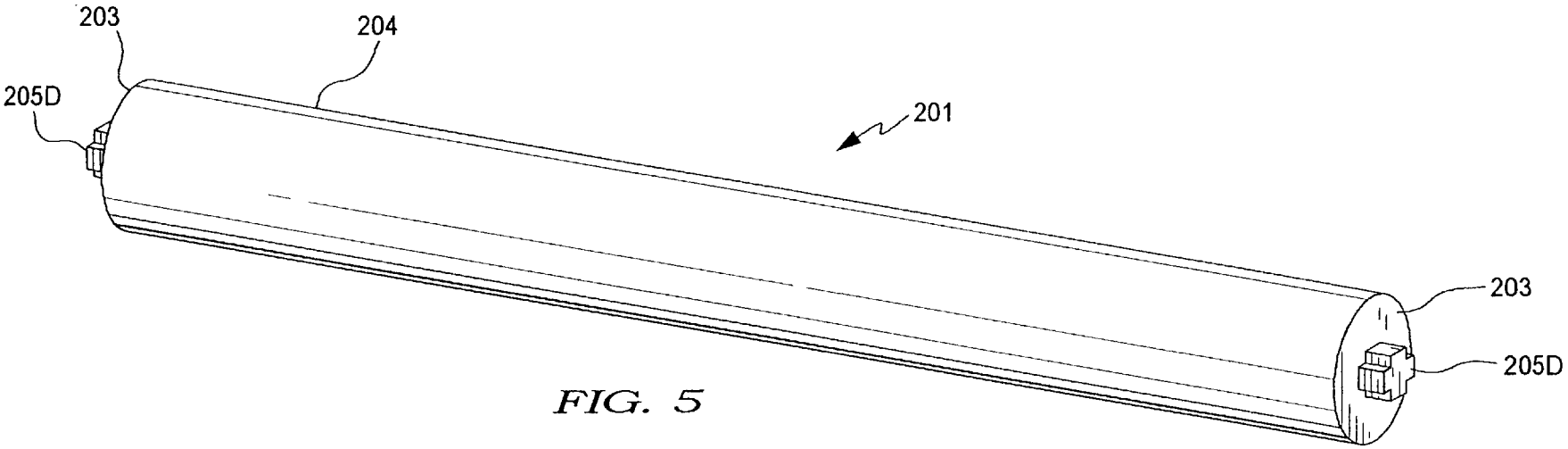
FIG. 5 shows an interblock connector having an elongated cross-shaped projection at each of its first and second ends.
Figure 5B:
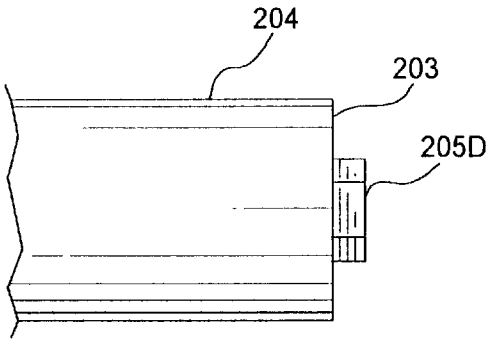
Figure 5A:
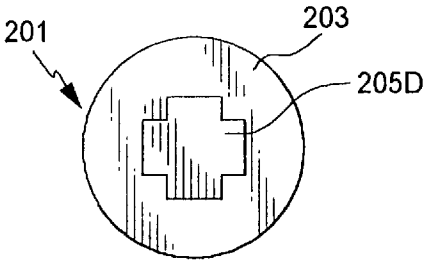

The present invention is a toy construction block system with interblock connectors for extended support structures. The present invention includes a plurality of toy construction blocks with recesses and a plurality of interblock connectors, which can all be arranged into a multitude of extended multi-block structures. The toy construction blocks used with the interlock connectors in the block system of the present invention have a top, four sidewalls and an open bottom, the top having a plurality of symmetrically arranged, elongated projections for interlocking with other, similar blocks; the open bottom exposing an underside to the top; the underside of the top having an elongated friction post extending therefrom, the friction post being hollow and being centrally and symmetrically located on the underside; the top having thereon a top recess in alignment with the friction post; the friction post having a bottom recess therein, and at least one of the four sidewalls having a side recess therein, the top recess, the bottom recess and the side recess adapted to receive an interblock connector.

In a preferred embodiment of the invention, an interblock connector comprises an elongated body having two end surfaces and an elongated projection extending therefrom. Said elongated projections are sized and shaped for insertion of the connector into a sidewall of a toy construction block so as to prevent separation of the connector and construction block. The elongated projection has a cross-section cooperating with the shape of the recess located within said sidewall of said construction block.

In another embodiment of the invention, an interblock connector comprises a strut element having an elongated body having two end flanges, each of which is defined by an end face of said element and a groove thereupon, said end face and groove having a spacing therebetween such that the end face of the element is firmly supported within the inner wall of a recess. The end flanges are adapted to be inserted laterally into a side recess of a toy construction block so as to be firmly and resiliently attached to said sidewall.

In yet another embodiment of the invention, an interblock connector comprises an elongated body having a pair of end surfaces and elongated projections extending therefrom. Said elongated body comprises a platelet having a plurality of orifices defined therein for attachment of the connector to at least one elongated projection extending from a top surface of a toy construction block. The orifices may be circular, triangular or any other shape which is sized and shaped to frictionally engage at least one of said elongated projections and prevent separation therefrom.

In still another embodiment of the present invention, an interblock connector comprises an elongated body having an end surface located at each of its two extremities. One end surface has an elongated projection extending therefrom for lateral insertion of the connector into a recess of a toy construction block. The other end surface of said connector defines a recess therein for receiving a tongue defined on an end surface of an adjacent interblock connector.

In another embodiment of the present invention, an interblock connector comprises an elongated body having an end surface located at each of its extremities. One end surface has an end flange extending therefrom, said end flange defined by an end face and a groove with a spacing therebetween. The other end surface has a partially serrated projection extended therefrom, said projection being U-shaped and having a grooved inner wall adapted for receiving an end flange from another interblock connector. This connector can also be altered such that both ends may have U-shaped projections, enabling the user to insert connectors with end flanges thereto and thus further extend the support structure.

In another embodiment of the present invention, an interblock connector comprises an elongated member having an end surface located at each extremity, and an additional connector is included to enable attachment of such interblock connectors to one another. One end surface has an elongated projection extending therefrom, said projection sized and shaped for insertion into a corresponding recess of a toy construction block. The other end surface defines a projection thereon, said projection having an inner wall and an outer wall defining a cavity therein. Said projection is adapted to receive another connector sized and shaped to attach to one of said projections on each side of said connector's midsection.

In another embodiment of the present invention, an interblock connector comprises a platelet having a top surface, a bottom surface and four side surfaces, said platelet having at least two orifices therein. These orifices are circumscribed by elongated, hollow projections that extend an equal distance from said top surface and said bottom surface. Each projection is defined by an inner wall and an outer wall defining a cavity therein, and each of said projections is sized and shaped to frictionally engage an elongated projection extending from a top surface of a toy construction block. Such projections can also interengage the hollow projection of an interblock connector described above, enabling the user to vary the extended support structure both vertically and horizontally.

In another embodiment of the present invention, an interblock connector can be unistructurally molded at one end or at both ends to a toy construction block having recesses. This embodiment enables the user to diversify the structure and permit multiple extensions of interblock connectors with a plurality of toy construction blocks therebetween.

The toy construction blocks and interblock connectors can be manufactured from molded plastic or any other suitable material known to be used in the art.

Figure 6:
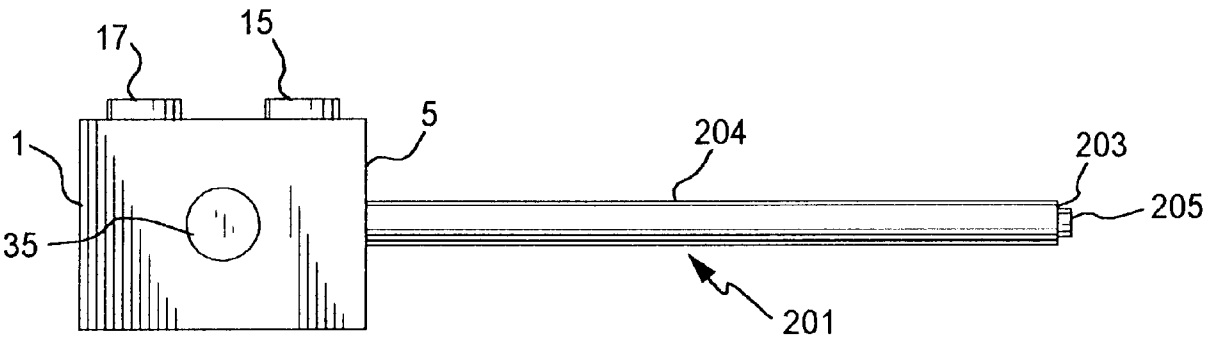
FIGS. 6 and 7 show a side view and a top view, respectively, of a partially constructed component comprising a toy construction block with side recesses connected to an interblock connector, said interblock connector having elongated projections corresponding to the shape of said recesses.
Figure 7:
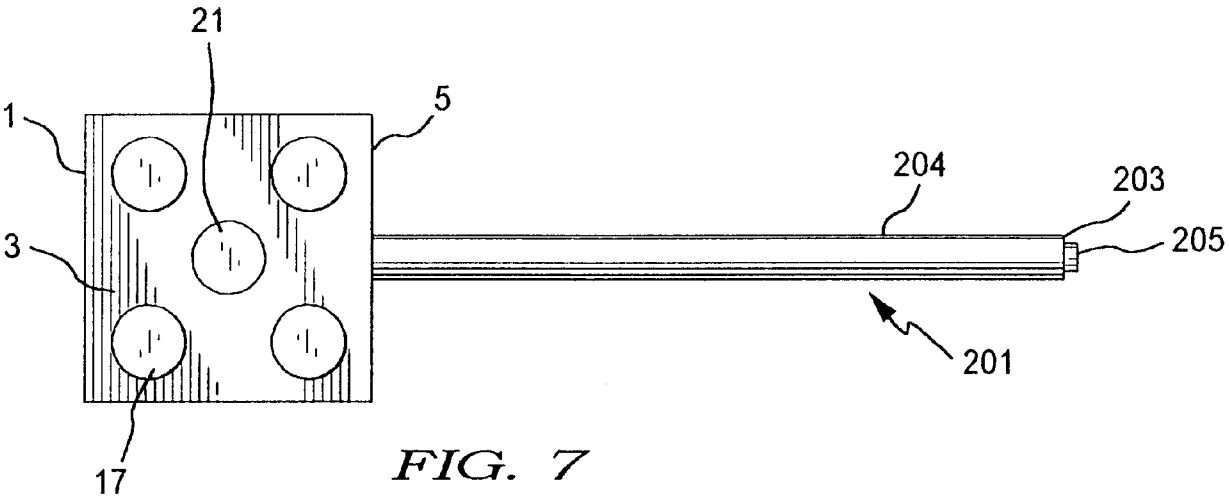

Referring now to FIGS. 1, 2, 3, 4 and 5, with identical parts being identically numbered, note that the figures show a perspective side view of an interblock connector 201 for toy construction blocks which has a main outer structure with an elongated body 204, end surfaces 203 and elongated projections 205 protruding from each end of the connector. FIGS. 1(*a*) and (1)*b* shows a front view and a side view, respectively, of an interblock connector having elongated circular projections 205. In each embodiment shown in FIGS. 1 through 5, the projections 205 are each sized and shaped to interengage a corresponding recess of a toy construction block. Note that FIGS. 6 and 7 show a side view and a top view, respectively, of a partially constructed component comprised of a toy construction block 1 attached to an interblock connector 201. Sidewall 5 has a recess 35, enabling connector 201 to be inserted laterally into block 1.

Figure 8:
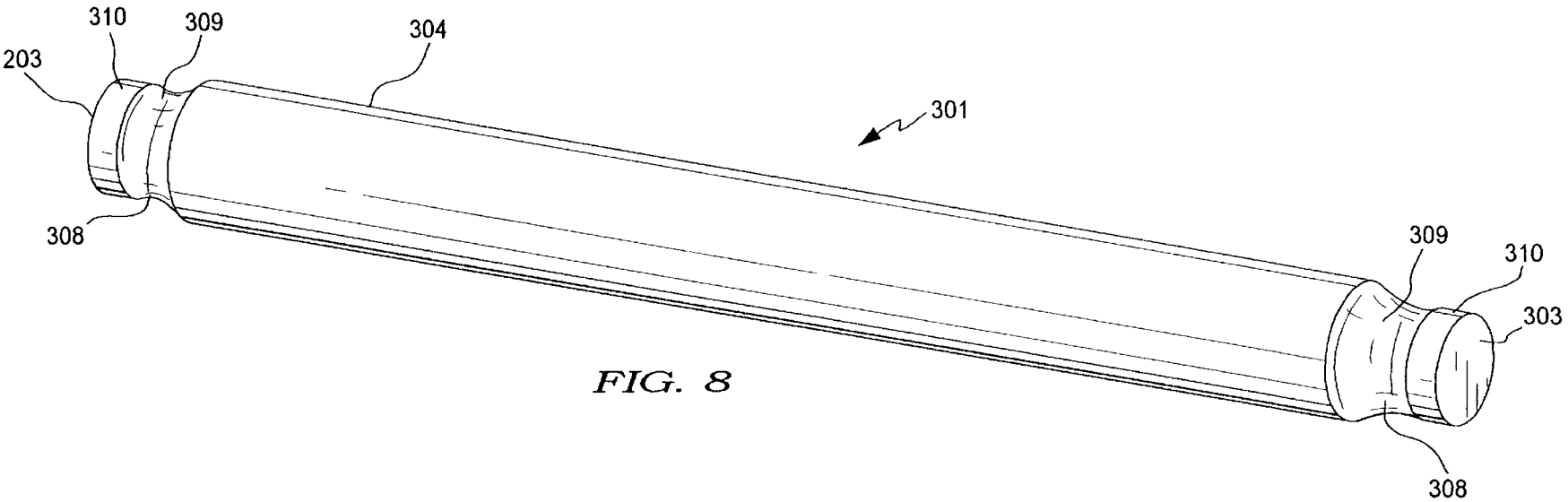
FIG. 8 shows an interblock connector having an end flange defined at each extremity by a groove and by an end face having a spacing therebetween, said end flange adapted for insertion into a toy construction block with recesses.
Figure 8B:
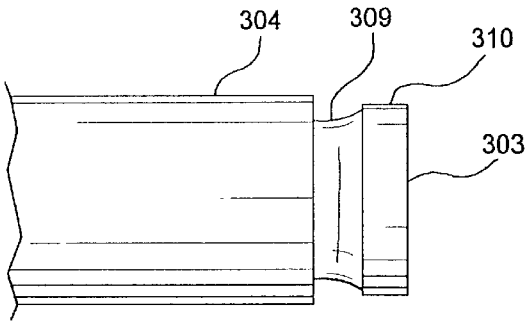
Figure 8A:
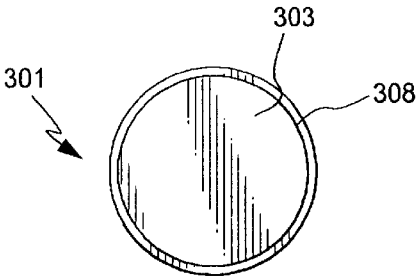
Figure 9:
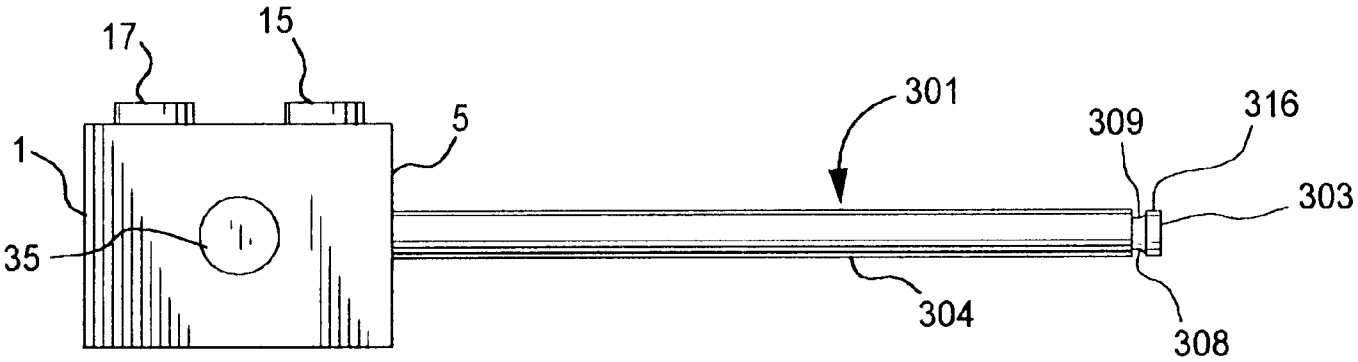
FIG. 9 shows a side view of a partially constructed component comprising the interblock connector of FIG. 8 connected to a toy construction block with recesses.
Figure 10:
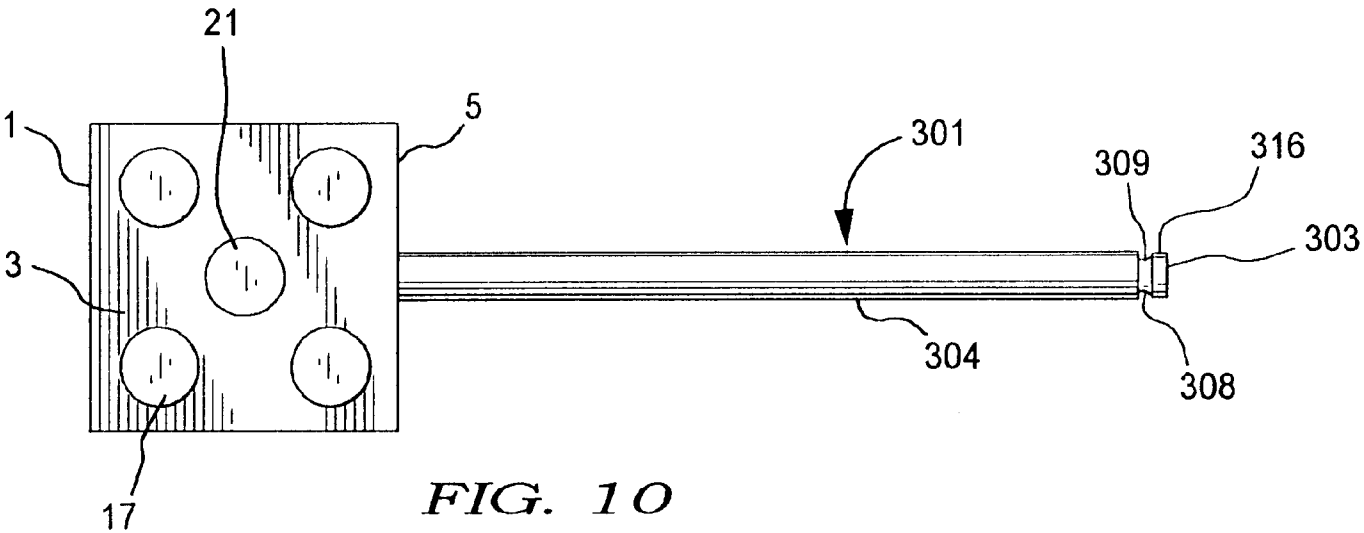
FIG. 10 shows a top view of the component of FIG. 9.

Referring now to FIG. 8, with identical parts being identically numbered, an alternative embodiment of an interblock connector 301 comprises a strut element having an elongated body 304 and end flanges 308 extending therefrom. Each end flange 308 is defined by a groove 309 and end face 303, groove 309 and end face 303 having a spacing 310 therebetween. End flange 308 is configured to be supported axially within a side recess 35 of a toy construction block 1. As shown in FIGS. 9 and 10, when connector 301 is inserted in said side recess 35, end face 303 is urged firmly and resiliently into contact with sidewall 5, preventing separation of connector 301 and block 1 and enabling construction of a plurality of extended support structures. Significantly, interconnector 301 may be used with other plastic toy construction units which have receivers and connector elements for strut elements. These may be used to create angular structures such as bridges, robots, houses, etc., enabling the user to now interconnect the present invention construction block system with plastic connector element toys sold under various trademarks and well known to the artisan.

Figure 11:
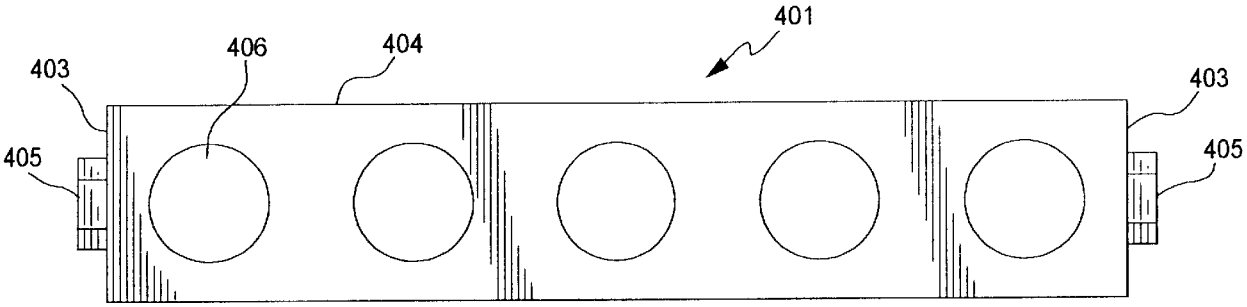
FIGS. 11 and 11(*a*) show side views of alternative embodiments of an interblock connector comprised of an orificed platelet, said platelet having elongated projections at each of its first and second ends for lateral insertion into a toy construction block with recesses.
Figure 11A:
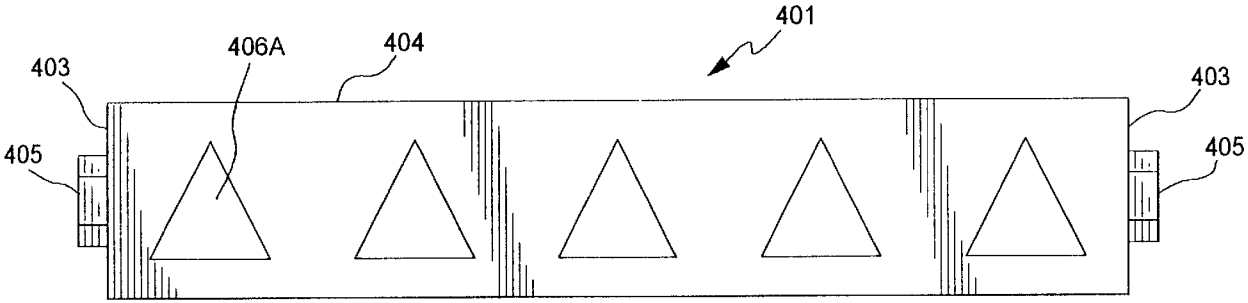
Figure 12:
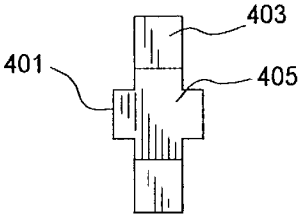
FIG. 12 is a front view of the interblock connector of FIGS. 11 and 11(*a*) having elongated projections which correspond to recesses in a toy construction block.

Referring now to FIGS. 11 and 12, an alternative embodiment of an interblock connector 401 comprises an orificed platelet having an elongated body 404, end surfaces 403 and elongated projections 405 that are sized and shaped to interengage a recess of a toy construction block. The elongated body 404 has a plurality of orifices 406 therein for connection of the connector 401 to elongated projections 61 and 63 of a toy construction block 2 (shown in FIGS. 13 and 13(*a*)). FIG. 11(*a*) further shows an alternative connector 401 with triangular orifices 406(*a*), but the orifices may be of any shape that enables attachment of the connector to at least one elongated projection of a toy construction block. Note that FIG. 12 shows a front view of an elongated projection 405 extending from end surface 403 of connector 401. Although projection 405 is shown in a cross shape, such projection can be any shape to correspond with a cooperating recess of a toy construction block.

Figure 13:
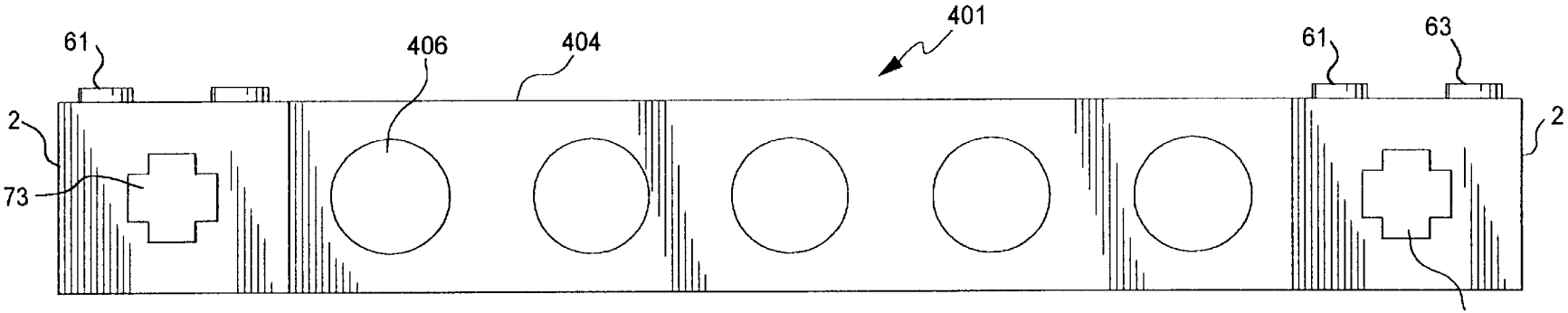
FIGS. 13 and 13(*a*) show side views of a partially constructed component comprised of the interblock connector of FIGS. 11 and 11(*a*), respectively, attached at both ends to a toy construction block with recesses.
Figure 13A:
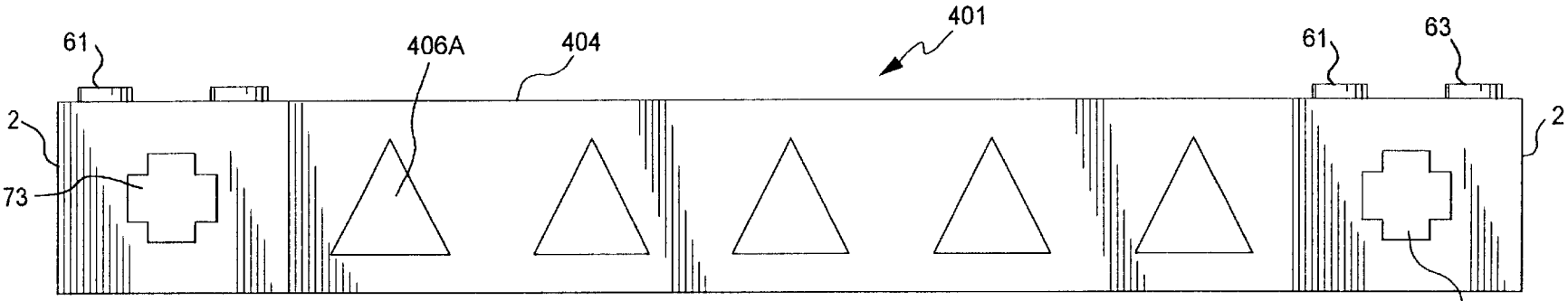

FIGS. 13 and 13(*a*) show partially constructed components comprised of a connector 401 and toy construction blocks 2 attached to end surfaces 403 by insertion of elongated projections 405 into recesses 73. Significantly, interconnector 401 may be used with other metal or plastic erection sets which have orifices for screws and nuts. These may be used to receive blocks such as block 2 on a diagonal so as to create a 45° angle for construction of bridges, robots, cranes, slanted roofs, etc. or may be used to receive blocks such as block 1 shown in FIG. 6 for lateral stacking or interconnecting of additional blocks. The present invention system will thus enable a user to now interconnect construction block toys with metal girder toys and plastic extender toys sold under various trademarks and well known to the artisan.

Figure 14:
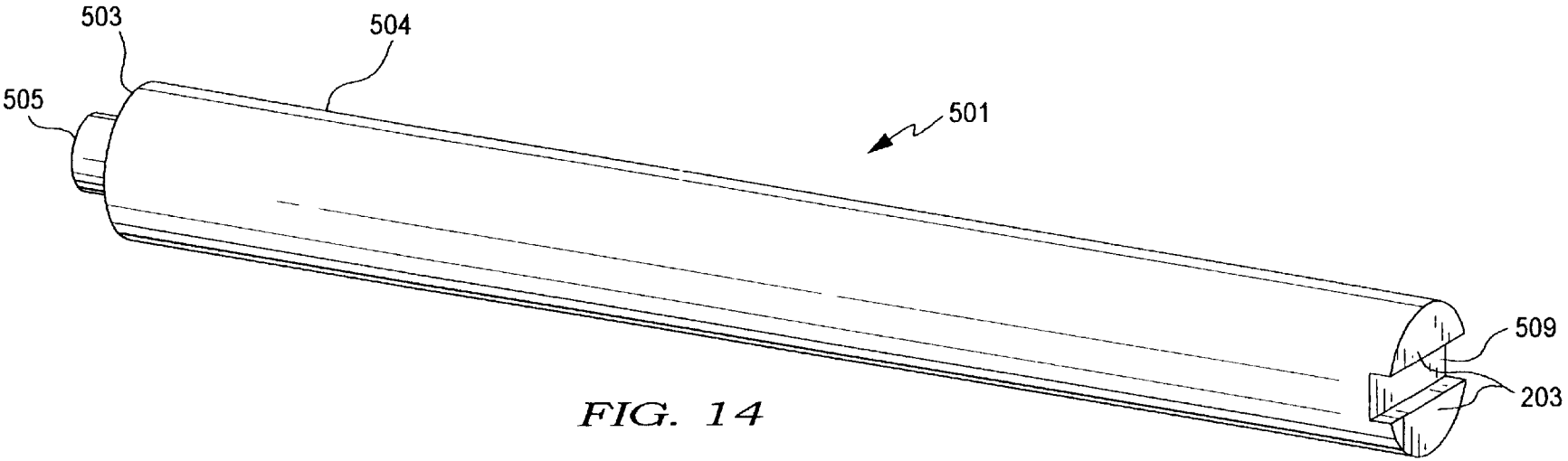
FIG. 14 shows an interblock connector having a recess defined at one of its first and second ends for engaging another interblock connector.
Figure 14B:
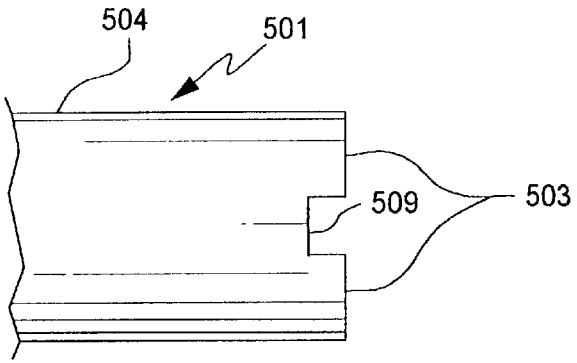
Figure 14A:
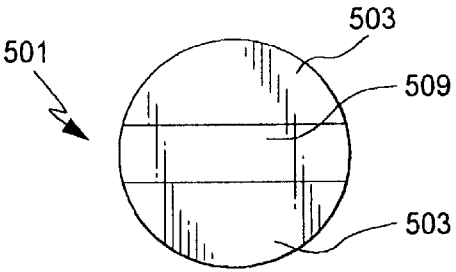
Figure 15:
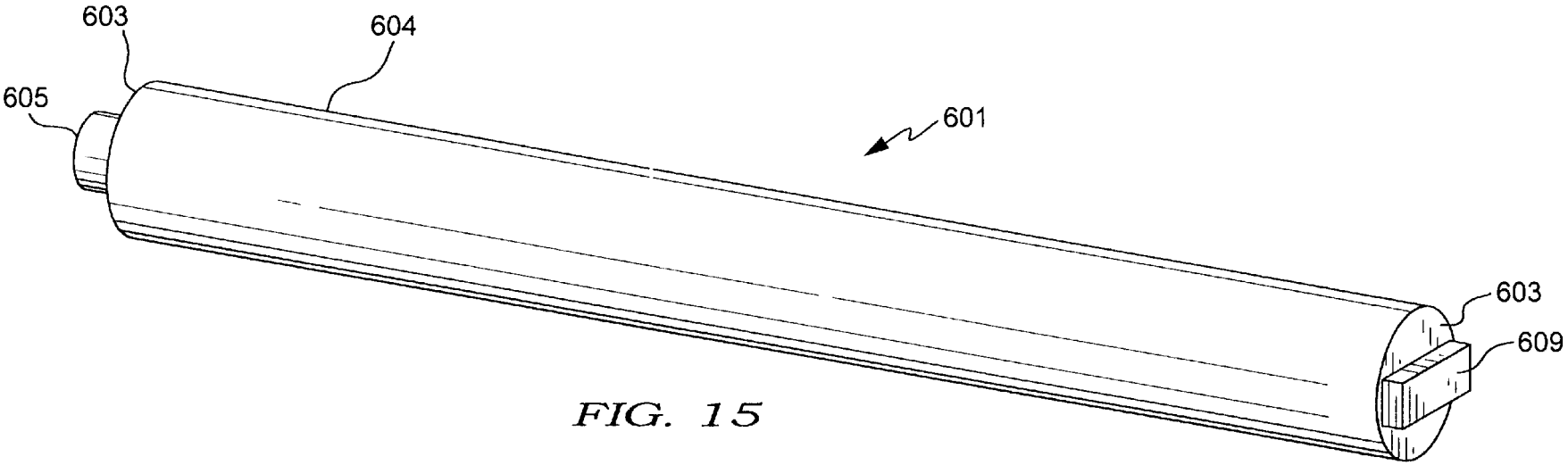
FIG. 15 shows an interblock connector having an elongated tongue for insertion into the recess of the interblock connector shown in FIG. 14.
Figure 15B:
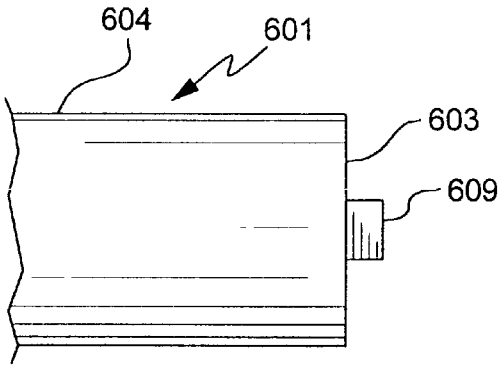
Figure 15A:
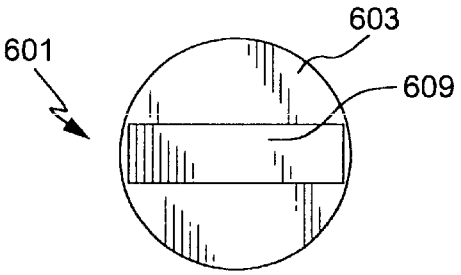

Referring now to FIG. 14, another alternative embodiment of an interblock connector comprises a connector 501 having elongated body 504, end surfaces 503 and an elongated projection 505 extending from one of said ends 503. The other end 503 defines a recess 509 for receiving a tongue 609 extending from an end surface 603 of connector 601, shown in FIG. 15. Tongue 609 slides into recess 509 so as to prevent separation of these interblock connectors from one another. Such connectors 501 and 601 then also have elongated projections 505 and 605, respectively, for insertion at the extremities into a recess 35 of a toy construction block 1. Said projections 505 and 605 are sized and shaped to retain a connector 501 or 601 in a sidewall 5.

Figure 16:
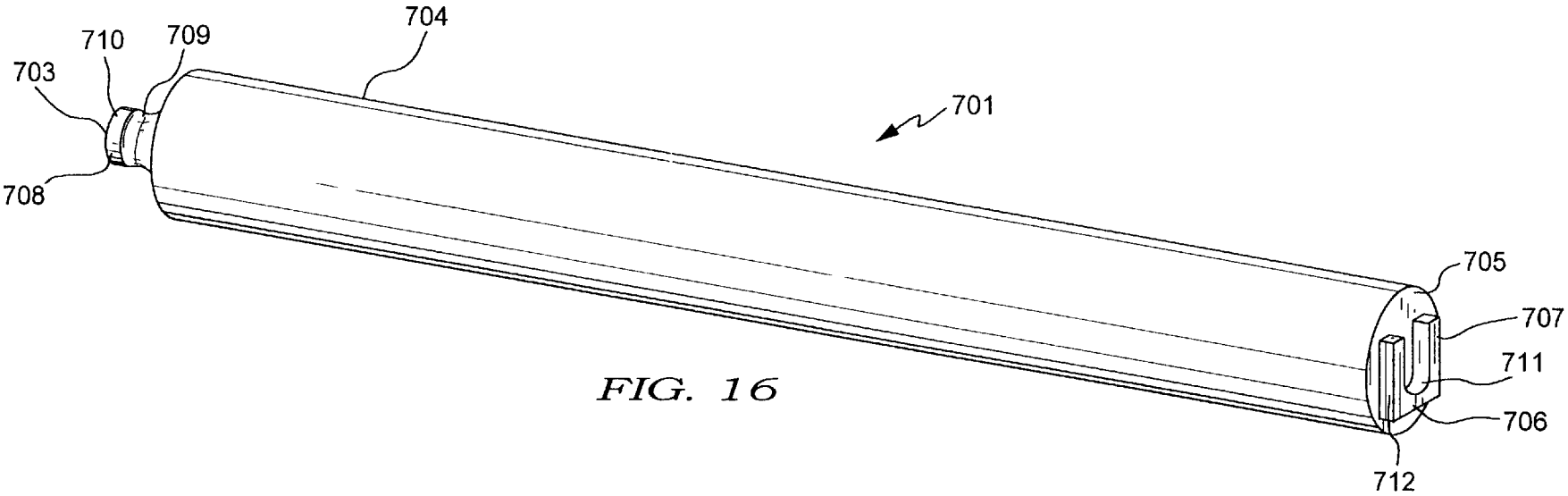
FIG. 16 shows an interblock connector having a partially serrated endpiece for receiving of an end flange of an interblock connector.
Figure 16B:
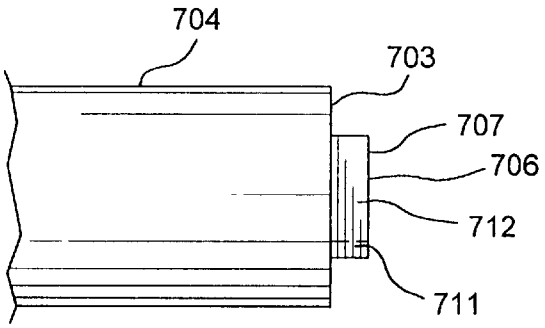
Figure 16A:
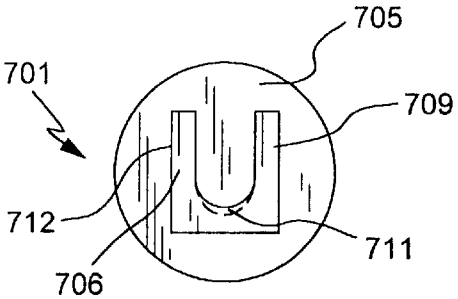
Figure 17:
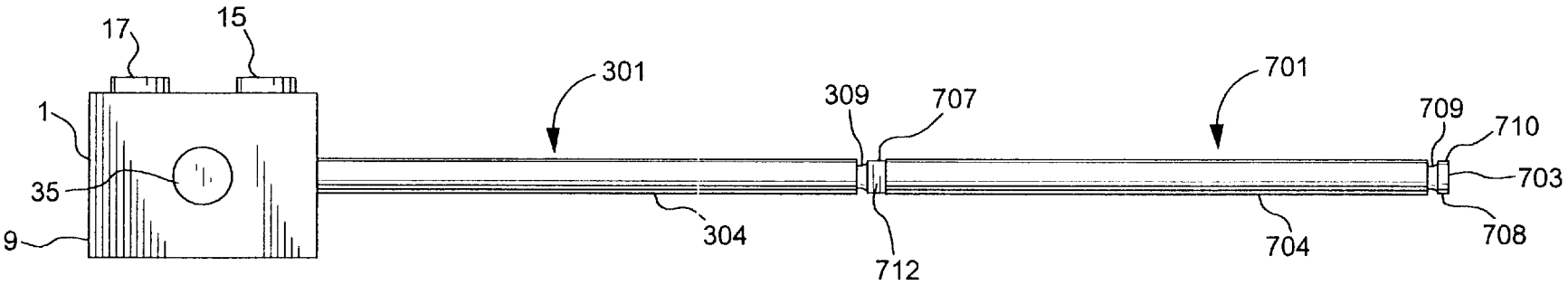
FIG. 17 shows a side view of a partially constructed component comprising the interblock connector of FIG. 16 connected to the interblock connector of FIG. 8. The connector of FIG. 8 is in turn connected to a toy construction block with recesses.

Referring now to FIG. 16, an alternative embodiment of a interblock connector comprises a connector 701 having an elongated body 704, and an end flange 708 defined at an extremity by an end face 703 and a groove 709 separated by a spacing 710. At the other extremity, a U-shaped projection 707 extends from end surface 705 and is defined by a front face 706, an outer wall 712 and a grooved inner wall 711. As shown in FIG. 17, a connector 301 is attached at one end to a block 1 by inserting an end flange 308 into a recess 35. At the other end, connector 301 is attached to a connector 701 by inserting and face 703 and spacing 710 within projection 708 by sliding said end face and spacing into said grooved inner wall 711. When end flange 708 is so inserted, end face 703 is urged firmly and resiliently into contact with inner wall 711, enabling further vertical and horizontal extension of toy construction block structures.

Figure 19A:
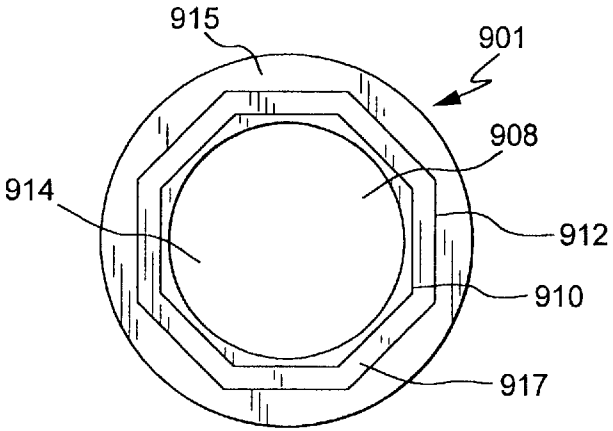
FIG. 19 shows attachment means for connecting one interblock connector to another interblock connector.
Figure 19:
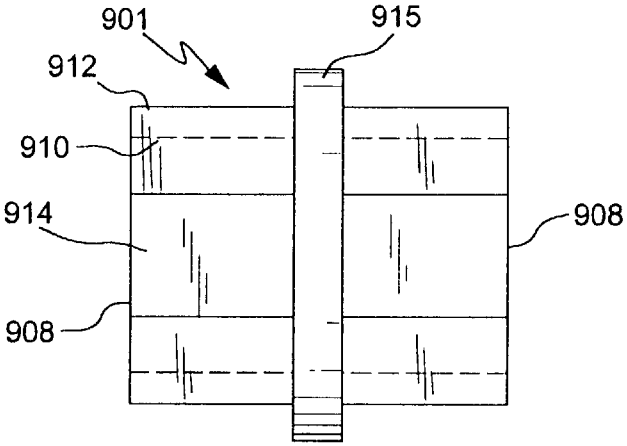
Figure 18:
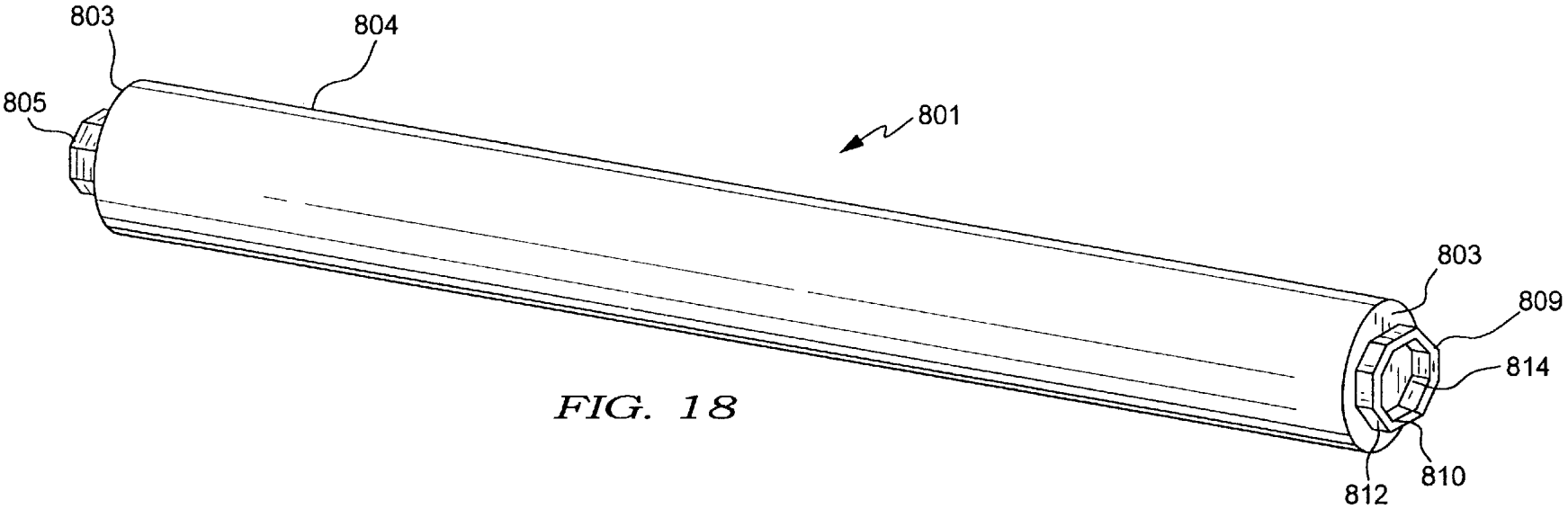
FIG. 18 shows an interblock connector with a hollow geometric protrusion for receiving of attachment means for connecting one interblock connector to another interblock connector.
Figure 18B:
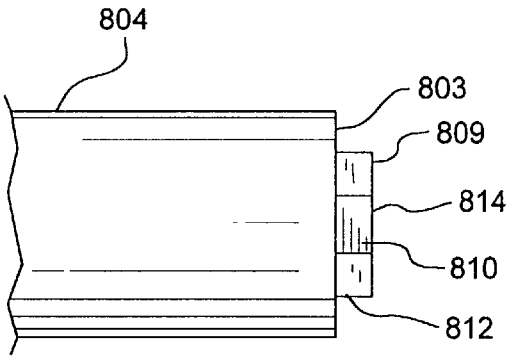
Figure 18A:
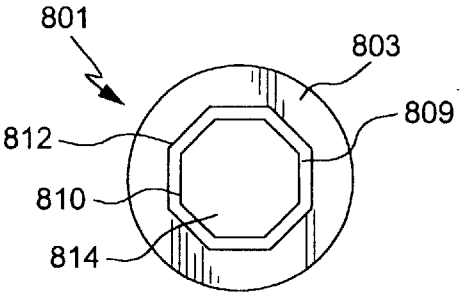
Figure 20:
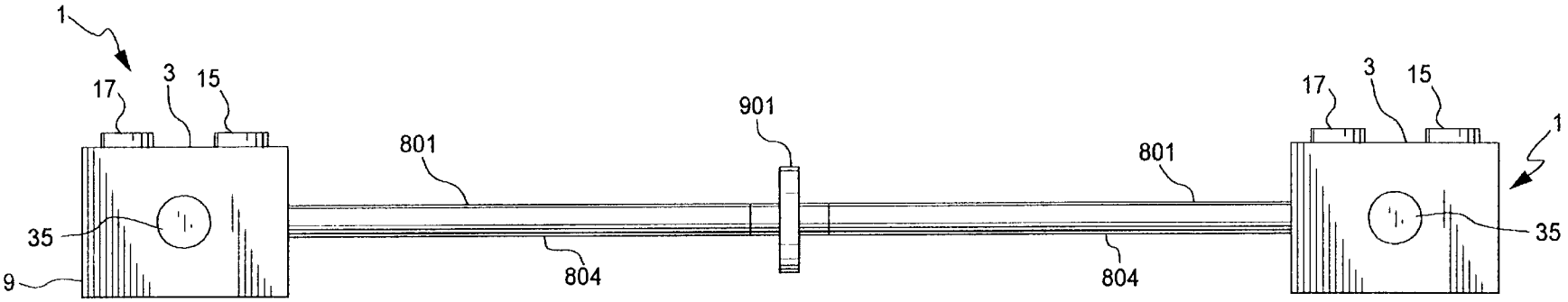
FIG. 20 shows a partially constructed component comprising a pair of the interblock connectors of FIG. 18 joined by the attachment means of FIG. 19. Each of the interblock connectors is affixed at its other extremity to a toy construction block with recesses.

Referring now to FIGS. 18 and 19, an alternative embodiment interblock connector comprises a connector 801 having an elongated body 804, end surfaces 803 and an elongated projection 805 at one end surface 803 for insertion into a recess 35 of a construction block 1. The other end surface 803 has extending therefrom attachment means comprising a projection 809, inner wall 810 and outer wall 812 defining cavity 814 therein. Such projection is sized and shaped to receive a connector 901 as shown in FIG. 19. Connector 901 has a circular grip 915 circumscribing the perimeter of the connector's midsection, as well as an inner wall 910 and an outer wall 912 defining a hollow interior 914 therein. FIG. 19(*a*) shows a front view of a connector 901 also having circular stop means 917, such stop means defined along the circumference of inner wall 910. Such stop means prevent insertion of an interblock connector 809 past the midpoint of connector 901, and also enable insertion of such an interblock connector (or, alternatively, an elongated projection of a toy construction block) into each orifice 908. For example, FIG. 20 shows a partially constructed component comprising a connector 901 joining a pair of connectors 801, said connectors 801 simultaneously being affixed at an extremity to a construction block 1 attached at one end to a block 1 and attached at the other end to a connector 901, said connector 901 also being attached to a second connector 801.

Figure 21A:
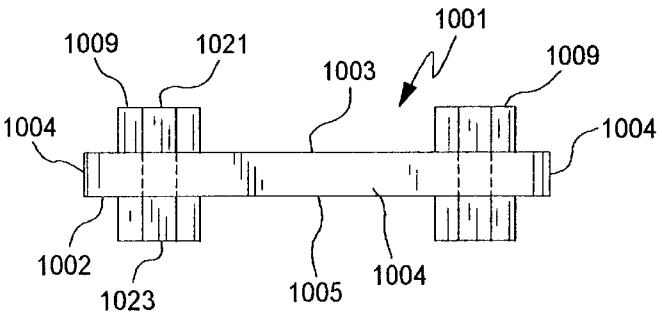
FIG. 21 shows an interblock connector comprised of a platelet having a pair of orifices for engaging the elongated projection of a toy construction block with recesses.
Figure 21:
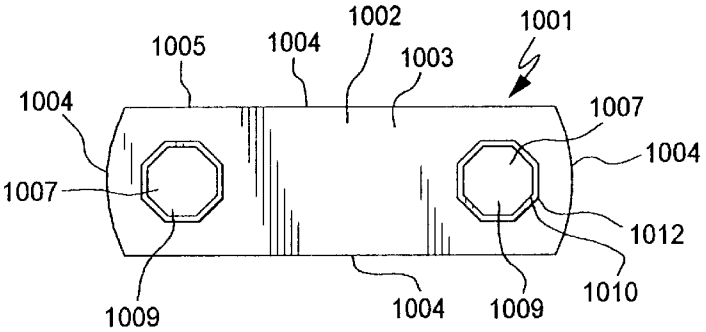
Figure 22:
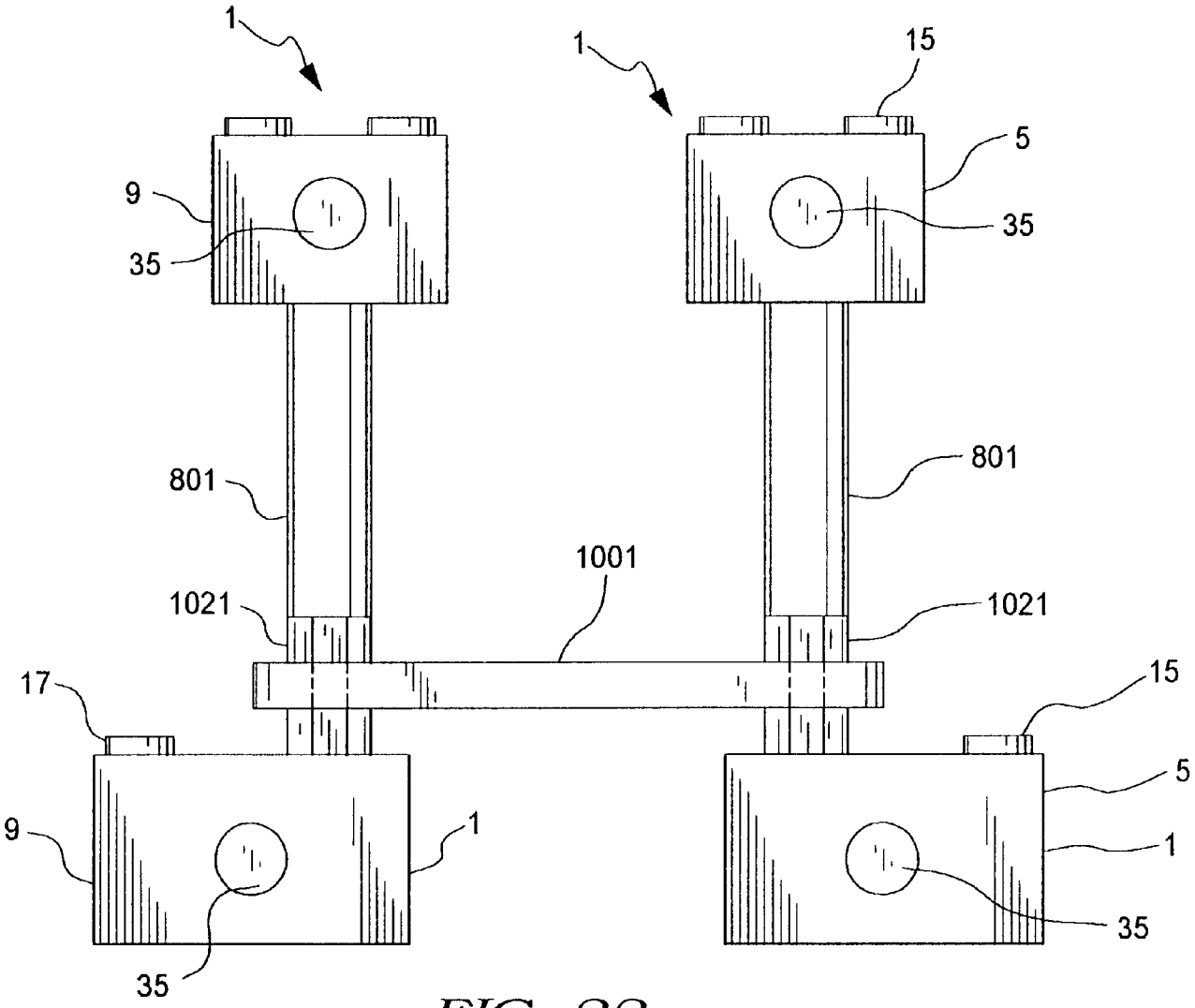
FIG. 22 shows a partially constructed component comprising present invention toy construction blocks joined by both vertical and horizontal interblock connectors.

Referring now to FIG. 21, an alternative embodiment of an interblock connector comprises an orificed platelet 1001 having a top surface 1003, a bottom surface 1005, four side surfaces 1004, and at least two orifices 1007 circumscribed by elongated projections 1009. As shown in FIG. 21(*a*), projections 1009 have a top surface 1021 and bottom surface 1023, said top surface 1021 and bottom surface 1023 each being equidistant from plate portion 1002. FIG. 22 shows a partially constructed component comprises of an interblock connector 1001, a pair of interblock connectors 801, and a plurality of toy construction blocks 1. As shown, it is an advantage of the present invention to create both vertically and horizontally extended structures that can interact with existing toy construction components already well known to the artisan.

Figure 23:
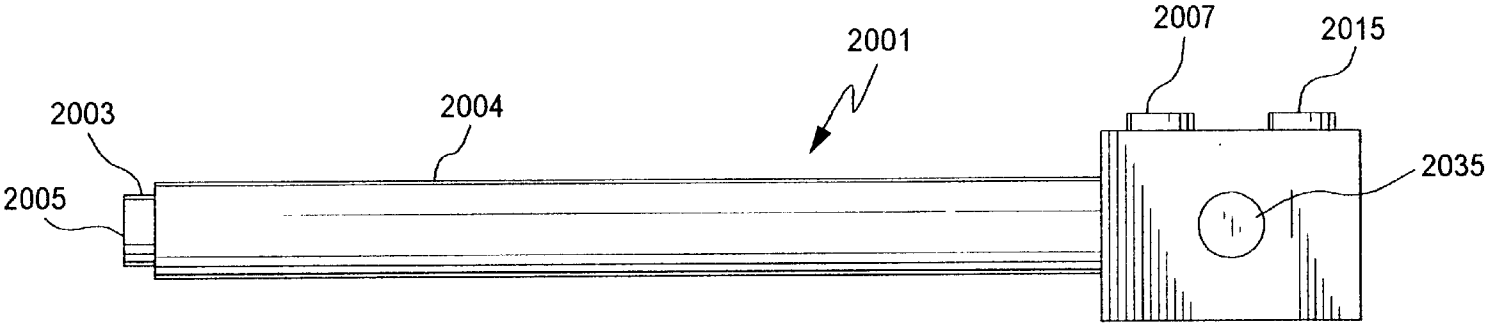
FIG. 23 shows a single-piece combined interblock connector and toy construction block.
Figure 24:
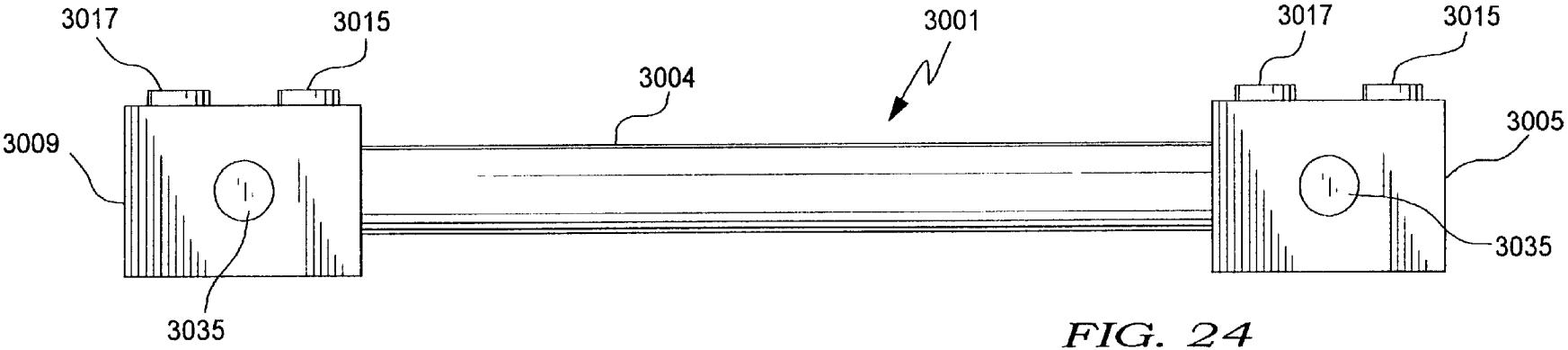
FIG. 24 shows a single-piece combined interblock connector and two toy construction blocks.

Referring now to FIGS. 23 and 24, an alternative embodiment of the present invention includes a combination interblock connector and toy construction block 2001, wherein said construction is molded to said interblock connector (FIG. 23). The interblock connector has an elongated body 2004, an end face 2003 and an elongated projection 2005 extending from end face 2003 for insertion into a recess 35 of a construction block 1. Another alternative embodiment shown in FIG. 24 (with like parts being similarly numbered) comprises a combination interblock connector and two toy construction blocks, wherein one of said toy construction blocks is molded to each end of an interblock connector (FIG. 24). The elongated body 2004 or 3004 may comprise a strut element or an orificed platelet (not shown). The elongated projection 2005 can have any cross-section corresponding to a recess in a sidewall of a toy construction block. The end face 2003 may also define an end flange (not shown) or a serrated projection for receiving an end flange from another interblock connector (not shown). Such combinations enable the interconnection of molded and non-molded elements to extend and vary the structures according to the desire of the user.

Obviously, numerous modifications and variations of the present invention are possible in light of the above teachings. It is therefore understood that within the scope of the appended claims, the invention may be practiced otherwise than as specifically described herein.

What is claimed is:

1. A toy construction block system, comprising:

(a) at least one block having a top, four sidewalls and an open bottom, said top having a plurality of symmetrically arranged, elongated projections for interlocking with other, similar blocks; said open bottom exposing an underside to said top; the underside of said top having an elongated friction post extending therefrom, said friction post being hollow and being centrally and symmetrically located on said underside; said top having thereon a top recess in alignment with said friction post; said friction post having a bottom recess therein, and at least one of said four sidewalls having a side recess therein, said top recess, said bottom recess and said side recess adapted to receive an interblock connector;

(b) a plurality of interblock connectors, each of said interblock connectors having an elongated body and first and second ends, wherein at least one of said first and second ends has means for interconnecting to one of said recesses of said block, and the other of said first and second ends has means for connecting to attachment means for joining such interblock connectors; and (c) at least one attachment means for joining one of said interblock connectors to another of said interblock connectors.

2. The attachment means of claim 1 comprising a connector defined by an inner surface, an outer surface and at least one side surface defining a cavity therein, said outer surface having a circular grip circumscribing the perimeter of said connector's midsection, said inner surface defining circular stop means within, said inner surface being smooth and adapted to frictionally engage said outer wall of a corresponding projection.

* * * * *